US008794352B2

(12) United States Patent
Halderman et al.

(10) Patent No.: US 8,794,352 B2
(45) Date of Patent: Aug. 5, 2014

(54) DRILLING FLUID RECOVERY WHEN DRILLING UNDER AN OBSTACLE OR WATER BODY

(75) Inventors: Ronald G. Halderman, Billings, MT (US); Karl D. Quackenbush, Blanchard, MI (US)

(73) Assignee: Quanta Associates, L.P., Houston, TX (US)

( * ) Notice: Subject to any disclaimer, the term of this patent is extended or adjusted under 35 U.S.C. 154(b) by 427 days.

(21) Appl. No.: 13/193,354

(22) Filed: Jul. 28, 2011

(65) Prior Publication Data

US 2012/0186881 A1 Jul. 26, 2012

Related U.S. Application Data

(60) Provisional application No. 61/368,506, filed on Jul. 28, 2010.

(51) Int. Cl.
*E21B 7/00* (2006.01)
*E21B 7/04* (2006.01)

(52) U.S. Cl.
USPC ..... 175/61; 175/62; 175/207; 175/209

(58) Field of Classification Search
USPC ..... 175/53, 61, 62, 207, 209, 213, 230, 10
See application file for complete search history.

(56) References Cited

U.S. PATENT DOCUMENTS

| | | | | |
|---|---|---|---|---|
| 4,121,673 | A | 10/1978 | Cherrington | |
| 5,096,002 | A | 3/1992 | Cherrington | |
| 5,269,384 | A | 12/1993 | Cherrington | |
| 5,351,764 | A * | 10/1994 | Cherrington | 175/53 |
| 5,375,669 | A | 12/1994 | Cherrington | |
| 5,711,385 | A | 1/1998 | Brotherton | |
| 7,070,359 | B2 * | 7/2006 | Richardson et al. | 405/141 |
| 2005/0045337 | A1 * | 3/2005 | Bansal et al. | 166/369 |
| 2012/0234551 | A1 * | 9/2012 | Keller et al. | 166/347 |

OTHER PUBLICATIONS

Bonghoon Lee, International Search Report, Apr. 4, 2012, 3 pages, Korean Intellectual Property Office, Daejeon, Korea.
Bonghoon Lee, Written Opinion of the International Searching Authority, Apr. 4, 2012, 5 pages, Korean Intellectual Property Office, Daejeon, Korea.

* cited by examiner

*Primary Examiner* — Brad Harcourt
(74) *Attorney, Agent, or Firm* — Mark A. Oathout; Oathout Law Firm

(57) ABSTRACT

A system for recovering drilling mud in drilling an underground arcuate path around at least a portion of an obstacle has a conductor casing, a drill pipe surrounded by the conductor casing for at least a portion of an axial length of the drill pipe, a flow line connected to the conductor casing at a downhole position, and a pump coupled to the flow line placed at another downhole position. A volume of drilling mud within the underground arcuate path is pumped from the underground arcuate path to the surface and recovered for recirculation.

15 Claims, 6 Drawing Sheets

DRILLING FLUID RECOVERY WHEN DRILLING UNDER AN OBSTACLE OR WATER BODY

CROSS-REFERENCE TO RELATED APPLICATIONS

This application claims the benefit of U.S. Provisional Application No. 61/368,506 filed Jul. 28, 2010 the disclosure of which is herein incorporated by reference.

STATEMENTS REGARDING FEDERALLY SPONSORED RESEARCH OR DEVELOPMENT

Not Applicable.

NAMES OF THE PARTIES TO A JOINT RESEARCH AGREEMENT

Not Applicable.

BACKGROUND

Prior apparatuses and methods have been used for drilling underground arcuate paths under and around obstacles. Such techniques use a directional drill motor or jet bit attached to a drill string. The directional drill motor or jet bit is used to drill a path from one side of the obstacle, going under and/or around the obstacle and exiting on the opposite side of the obstacle. After the steering equipment has been removed a reamer can be attached to the drill string and pulled back or pushed through the hole to further enlarge the diameter of the hole. Reamers of consecutively larger diameters can be pushed and pulled back through the hole until a desired diameter is reached. The reamer is then attached by a swivel connected to the casing intended to be installed in the hole. The reamer is then pulled back through the hole followed by the swivel connection to the casing until the casing occupies the hole. A swivel is required to keep torque from being transmitted from the drill string and reamer to the casing.

Drilling fluid or "mud" is used to power the drill motor or jet bit and reamer and to clean the drilled hole of cuttings and stabilize the hole. Drilling fluids are generally composed of water and bentonite (high swelling clay) plus lesser amounts of special additives. The composite mixture produces a relatively viscous fluid with the capacity to entrain and carry soil and rock particles. Five to fifteen barrels per minute of mud must be pumped under sufficiently high pressure to power a typical drilling system. This fluid is pumped under pressure from the mud pump located at the surface next to the drilling rig, down through the drill pipe occupying the hole and out through the bit at the end of the drill string. Hole cutting is accomplished either by direct hydraulic jetting for soft soils or by use of a mud motor and drill bit for harder soils and rock. The fluids exit the bit in turbulent flow at the end of the borehole (face). As the fluids reverse course and move back up the annular space between the drill pipe and the borehole wall they lose velocity largely due to friction. The laminar flowing fluids carry "cuttings" (soil and rock particles) back up the annular space to the surface where they are collected and "cleaned". The reconstituted fluids are then pumped back down the drill pipe. The drilling fluids are thus recycled as much as possible.

Horizontal drilling productivity and efficiency is directly related to maintaining constant and continuous drilling fluid "returns" along the bored path back to the entry point at the surface. An event commonly referred to as a "frac-out" occurs when excessive drilling pressure results in drilling mud escaping from the borehole and propagating toward the surface (e.g. the ground fractures and fluid escapes or propagates toward the surface). A frac-out can be costly due to work stoppage for cleanup and can severely affect environmentally sensitive areas.

A need therefore exists for apparatuses and methods for eliminating or substantially reducing these all too frequent frac-outs or inadvertent returns.

SUMMARY

The primary advantages to be achieved by the embodiments disclosed herein are lower potential for frac-outs, full or near-full returns thereby increasing drilling productivity and efficiency, notably lower fresh water requirements, better management of mud rheology and enhanced borehole stability.

These advantages are essentially gained by collecting returning drilling fluids at a lower elevation along the drilled route by the use of internal and/or external submersible pumps.

A system for recovering drilling mud in drilling an underground arcuate path around at least a portion of an obstacle has a conductor casing, a drill pipe surrounded by the conductor casing for at least a portion of an axial length of the drill pipe, a flow line connected to the conductor casing at a downhole position, and a pump coupled to the flow line placed at another downhole position. A volume of drilling mud within the underground arcuate path is pumped from the underground arcuate path to the surface and recovered for recirculation.

As used herein the meaning of the term "working" shall include drilling, reaming and the like for use in constructing or creating an underground arcuate path, and the term "drilling" shall likewise include working. Terms such as "drill pipe", "drill casing", etc. shall have meanings in accordance with same.

DETAILED DESCRIPTION OF THE EMBODIMENT(S) SHOWN

The description that follows includes exemplary apparatus, methods, techniques, and instruction sequences that embody techniques of the inventive subject matter. However, it is understood that the described embodiments may be practiced without these specific details.

Figure 1:
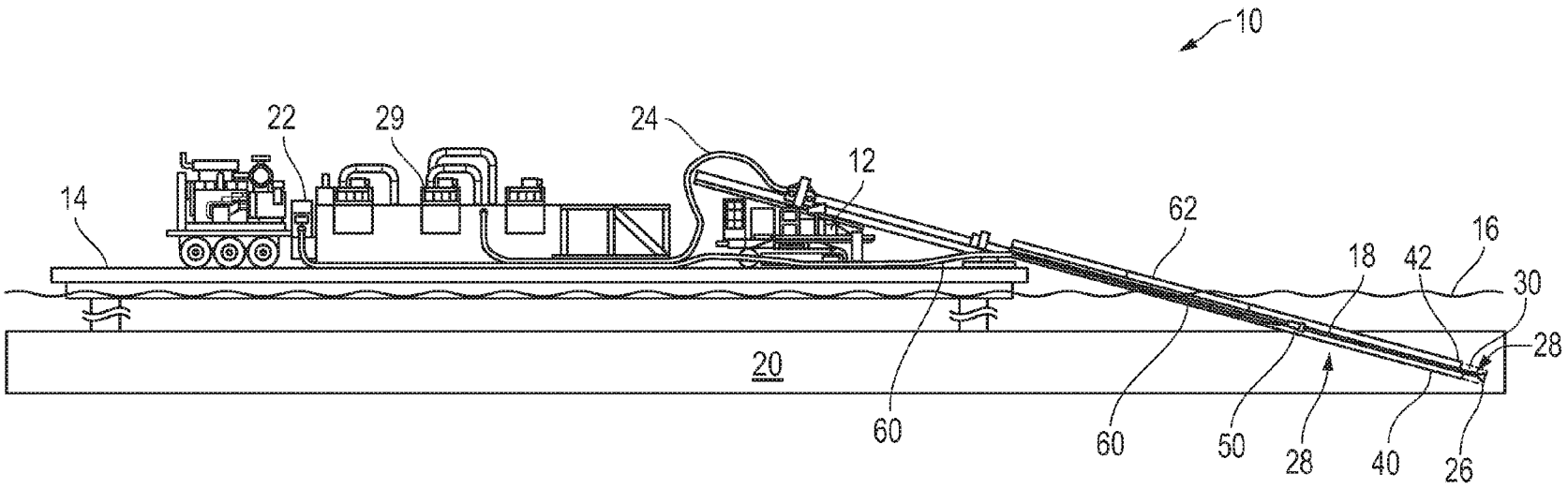
FIG. 1 depicts a schematic elevation view of an embodiment of a drilling rig on a slab or platform and the mud recovery system having an external return line(s) using an installed conductor that allows the return mud to circulate back to surface.
Figure 2:
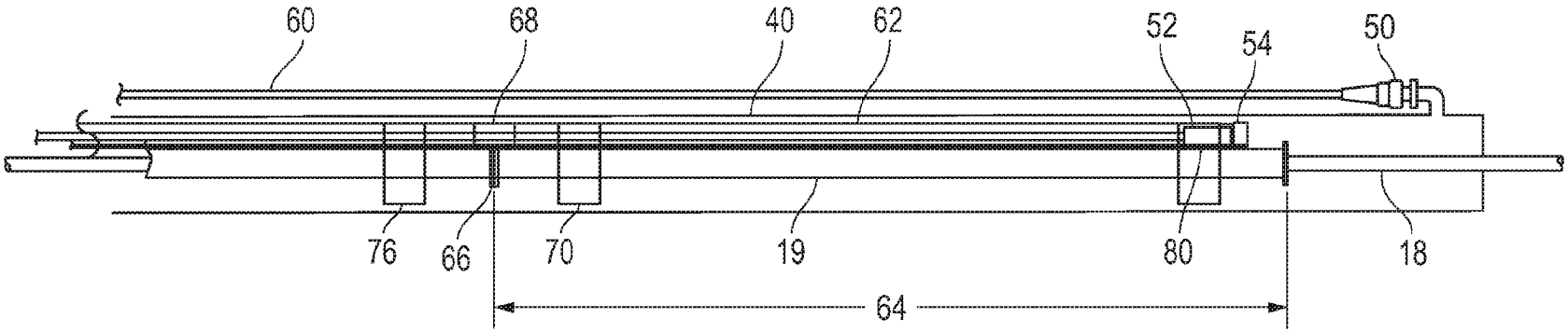
FIG. 2 represents an embodiment of a mud recovery system combining internal and external recovery flow lines.
Figure 3:
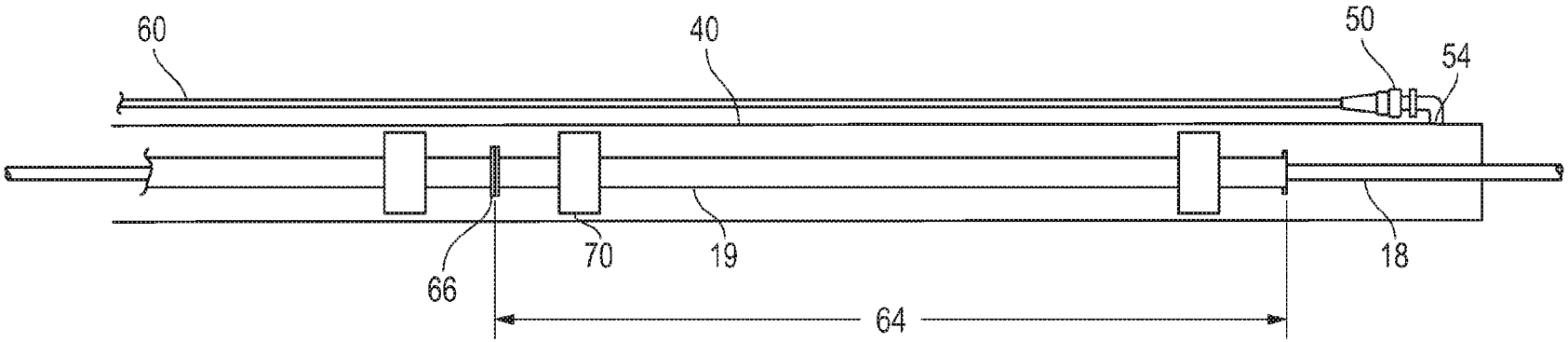
FIG. 3 represents an embodiment of a mud recovery system with external recovery flow line(s).
Figure 4:
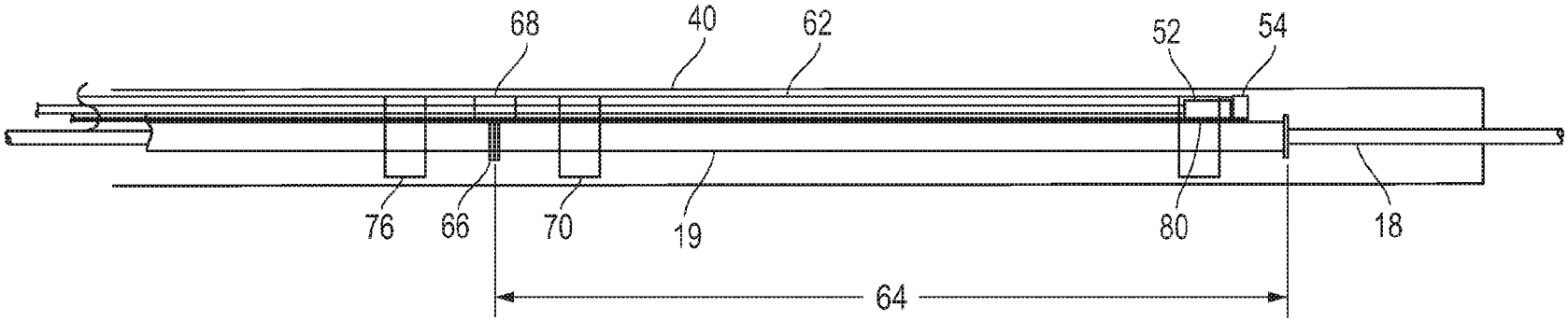
FIG. 4 represents an embodiment of a mud recovery system with internal recovery flow line(s).
Figure 7:
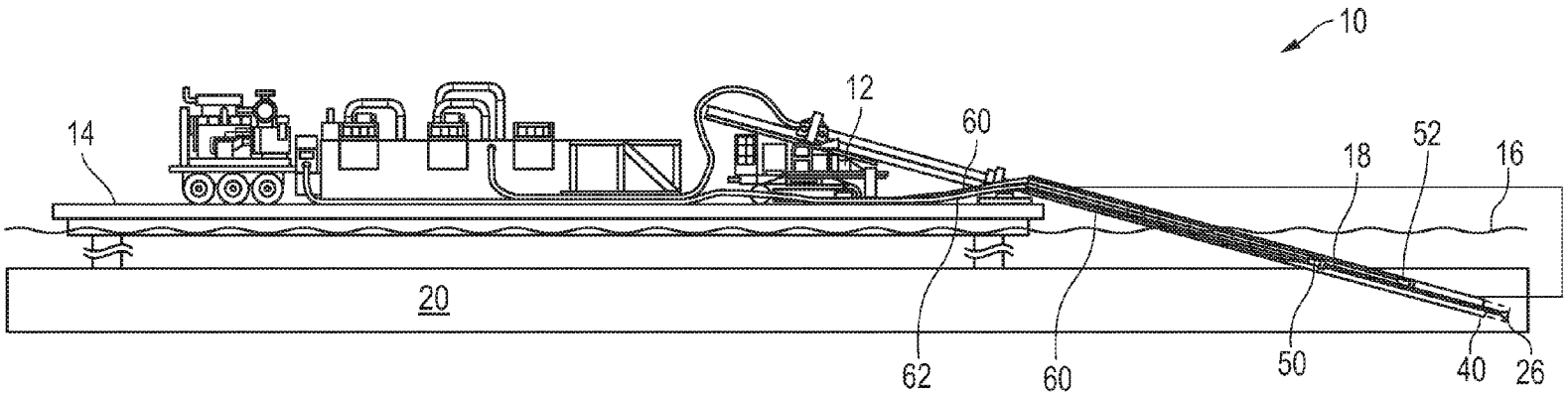
FIG. 7 depicts a schematic elevation view of an embodiment of a drilling rig on a slab or platform and the mud recovery system having both external and internal return lines using an installed conductor that allows the return mud to circulate back to surface.
Figure 8:
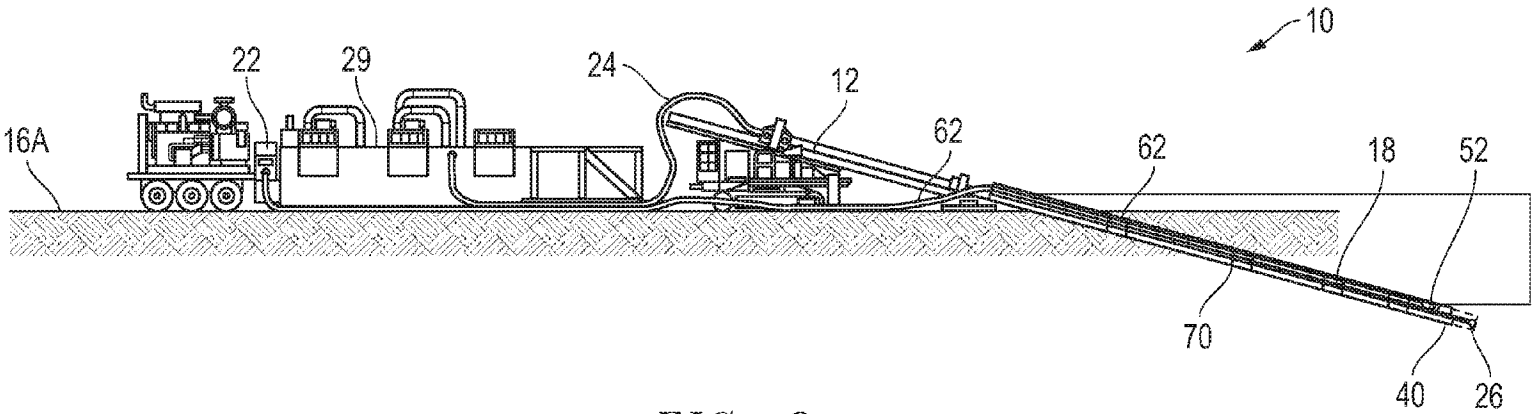
FIG. 8 depicts a schematic elevation view of an embodiment of a drilling rig on land and the mud recovery system having internal return lines only using an installed conductor that allows the return mud to circulate back to surface.

Referring to FIG. 1, FIG. 7 and FIG. 8, three embodiments of a mud recovery system 10 are shown. A drilling rig 12 may be mounted on a slab or platform 14 above the surface 16 (water, marsh, etc. in FIGS. 1 and 7) or surface 16*a* (land in FIG. 8). The drilling rig 12 loads and advances drill pipe 18 by turning and pushing into ground or rock formation 20 at a planned degree of angle. A mud pump 22 sends a volume of drilling mud or drilling fluid at a calculated pressure and flow through the hose assembly 24 towards the drill rig 12. Drilling mud than travels through the interior of the drill pipe 18 exiting the down hole tooling 26. Once the exhausted volume of mud 28 has circulated in the bore 30 to the lead edge 42 of the conductor casing 40 (located, by way of example only, but not limited to, one hundred feet down the bore path 30), the exhausted volume of drilling mud 28 (normally containing entrapments from the bore hole) is recovered by a pump or a series of pumps 50 (see e.g. FIGS. 1 and 7) and/or pump(s) 52 (see e.g. FIGS. 2, 7 and 8) that are placed with external flow line(s) 60 (see e.g. FIGS. 1 and 7) and/or internal flow line(s) 62 (see e.g. FIGS. 2, 7 and 8) and positioned downhole in the region or vicinity of the conductor casing 40 and can travel along the underground arcuate path. The discharge of the pump(s) 50 and/or 52 travels to surface 16 or 16*a* through flow line(s) 60 and/or 62, sending the volume of drilling mud 28 with suspended soils and cuttings back to the recycler 29.

Referring to FIGS. 2-6 various embodiments of the mud recovery system 10 are shown. The mud recovery system 10 is not limited to these embodiments and generally contains, but is not limited to, a conductor casing 40, a stabilizer assembly 70, a flow line or lines 60 and/or 62, and agitators 80.

The conductor casing 40 can vary in length and diameter and is accountable for containing surface water table and supporting or stabilizing the surrounding formation.

The stabilizer assembly 70 has a centralizer casing 72 with a plurality of struts 74 attached at one end to the centralizer casing 72 and attached at the other end to the drill casing 19 by, for example, a circular flange 78. The drill casing 19 is used to support drill pipe 18 during the drill process. The centralizer casing 72 is preferably, but not limited to, a set of spaced tubular rings 76.

External flow line 60 and/or internal flow line 62 transport exhausted drilling mud back 28 above the surface 16 for recycling. Consecutive internal mud recovery system sections 64 may be joined by an internal mud return casing flange 66. Consecutive sections of internal flow lines 62 (as defined by internal mud recovery system sections 64) may be joined by a coupling 68. One having ordinary skill in the art can build a mud recovery system 10 that is optimal for a particular job or application by stringing together any variety of combinations and/or like sections of external flow lines 60 and internal flow lines 62 with respective pumps 50 and/or pumps 52 (for example, external flow lines 60 and external pumps 50 are not preferably used for drilling into sections of land as opposed to water).

External pump(s) 50 and/or internal pump(s) 52 move drilling mud 28 to the recycler 29. A screen 54 restricts large materials from entering the pump(s) 50 and/or 52. Screen 54 may be made as part of the pumps 50 and/or 52 as desired by one having ordinary skill in the art. Screen 54 may also be mounted over any inlet to a flow line 60 and/or 62. The pumps 50 and or 52 with or without screen 54 may be commercially available from a suitable supplier such as, for example, a submersible pump from HYDRA-TECH PUMPS, or GORMAN-RUPP PUMPS.

Agitators 80 (e.g. small tube(s) 82 running from the platform 14 and having small diameter openings at desirable intervals for jetting fluid/gas) agitate drilling mud 28 around screen 54 and pump 52 with high pressure water and/or air to prevent gelling.

Figure 5:
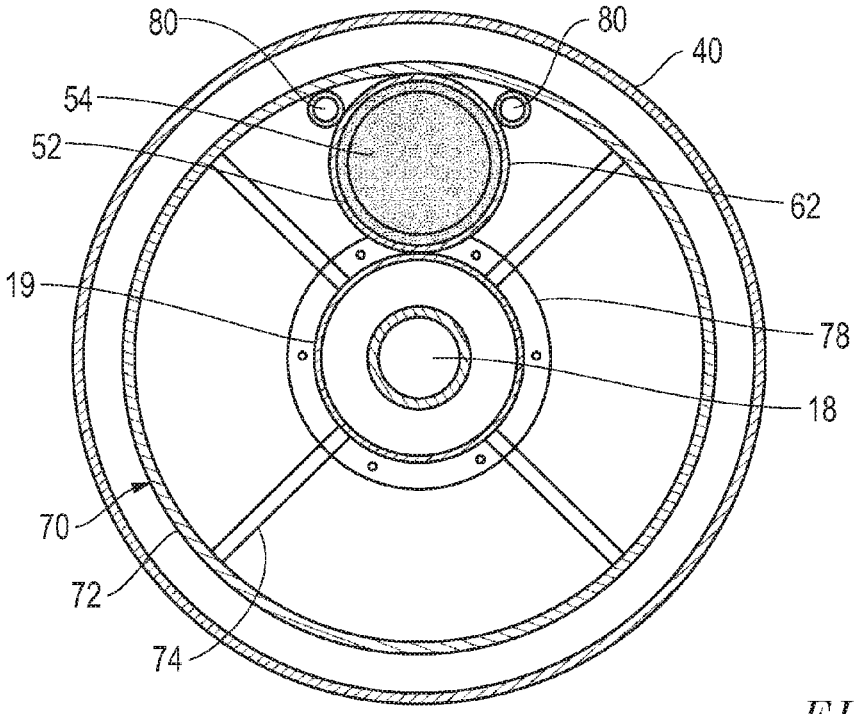
FIG. 5 depicts a cross-sectional view of a mud recovery system according to a symmetrical configuration of an embodiment.
Figure 6:
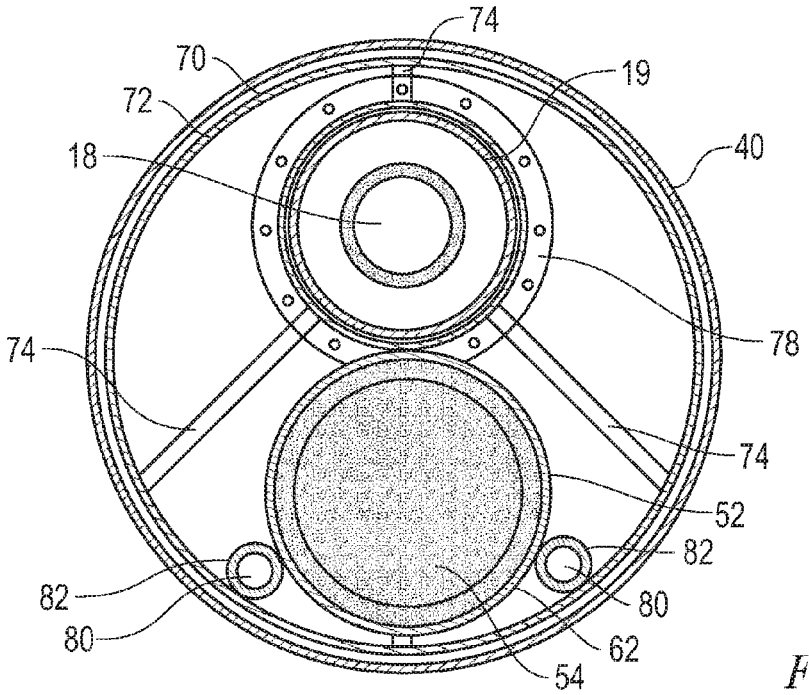
FIG. 6 depicts a cross-sectional view of a mud recovery system according to an asymmetrical configuration of an embodiment.

The internal mud recovery system/embodiment (see, e.g., FIGS. 2, 4, 5 and/or 4) is easily extended downward inside conductor casing 40 by bolting individual sections 64 together via flanges 66 as needed. In the internal mud recovery system/embodiments the flow line 62 is juxtaposed between the drill casing 19 and the centralizer casing 72. In the embodiment of FIG. 5 the drill casing 19 and the conductor casing 19 are concentric and in the embodiment of FIG. 6 they are eccentric.

The mud recovery system 10 can be used from a barge or fixed platform 14 on the water in a water-to-water drill, a water-to-land drill, a land-to-water drill, or in a more conventional land-to-land drill. Optionally, a grout seal can be set at the end of the conductor casing 40 to isolate the system 10 from external sea or ground water.

There are many situations in which the mud recovery system 10 could demonstrate significant benefits. In levees, the mud recovery system 10 can substantially reduce the hydrostatic head under the levee (i.e. by creating a lower elevation preferential vacuum or lower pressure region located along the drilled route for returning fluids/mud) thereby substantially reducing the chance of destabilizing the levee. In shallow bedrock, the mud recovery system 10 could be used to allow drilling to be performed without drilling in the bedrock in areas where there is a relatively higher potential for frac-out due to the limited depth of cover. In long drill applications, the combined use of the mud recovery system 10 and intersect technology contributes to regular planning and design of horizontal directional drilling in lengths to and exceeding 3048 meters (ten thousand feet). In environmentally sensitive areas, the mud recovery system 10 provides a lower-risk scenario for crossing under wetlands, pristine water bodies, and urban locations.

While the embodiments are described with reference to various implementations and exploitations, it will be understood that these embodiments are illustrative and that the scope of the inventive subject matter is not limited to them. Many variations, modifications, additions and improvements are possible.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

What is claimed is:

1. An apparatus for working an underground arcuate path around at least a portion of an obstacle, comprising a conducting casing;

a drill pipe surrounded by the conductor casing for at least a portion of an axial length of the drill pipe;

a flow line connected to the conductor casing at a downhole position, wherein said flow line is connected internal to the conductor casing;

a pump coupled to said flow line at another downhole position;

a drill casing surrounding the drill pipe; and a stabilizer assembly mounted inside the conductor casing and attached to the drill casing.

2. The apparatus according to claim 1, further including a downhole tooling connected to the drill pipe.

3. The apparatus according to claim 1, wherein said pump is coupled to an inlet end of said flow line.

4. The apparatus according to claim 3, wherein said pump is a sump pump.

5. The apparatus according to claim 3, further including a screen connected to an inlet side of said pump.

6. The apparatus according to claim 1, wherein said flow line is connected external to the conductor casing.

7. The apparatus according to claim 1, wherein said stabilizer assembly comprises:

a plurality of struts attached at one end to the drill casing; and a centralizer casing attached to the other end of the plurality of struts.

8. The apparatus according to claim 7, wherein said centralizer casing comprises a tubular ring.

9. The apparatus according to claim 7, wherein the drill casing is concentric with conductor casing.

10. The apparatus according to claim 9, wherein said flow line is juxtaposed between both the drill casing and said centralizer casing.

11. The apparatus according to claim 10, further comprising at least one agitator pipe mounted contiguous to said flow line and said centralizer casing.

12. The apparatus according to claim 7, wherein the drill casing is eccentric with conductor casing.

13. The apparatus according to claim 12, wherein said flow line is juxtaposed between both the drill casing and said centralizer casing.

14. The apparatus according to claim 13, further comprising at least one agitator pipe mounted contiguous to said flow line and said centralizer casing.

15. The apparatus according to claim 1, wherein said pump is coupled to an inlet end of said flow line; and further including at least one agitator mounted contiguous to an inlet to said pump.

* * * * *